US006101646A

United States Patent [19]

Son

[11] Patent Number: 6,101,646

[45] Date of Patent: Aug. 15, 2000

[54] DUAL-FUNCTION FOLDING BED USED AS CHAIR EQUIPPED WITH PATIENT TOILET

[76] Inventor: Chong Eun Son, Sekeyong 3 cha Apt. 301-609 Hupyeong 1 Dong, Chuncheon city, Kangwon-do, Rep. of Korea

[21] Appl. No.: 09/336,743

[22] Filed: Jun. 21, 1999

[30] Foreign Application Priority Data

Jun. 22, 1998 [KR] Rep. of Korea ..... 98-23333

[51] Int. Cl.[7] ..... A61G 7/02

[52] U.S. Cl. ..... 5/604; 5/605

[58] Field of Search ..... 5/604, 605, 606, 5/695, 928

[56] References Cited

U.S. PATENT DOCUMENTS

| | | | |
|---|---|---|---|
| 1,945,081 | 1/1934 | Ryan et al. | 5/605 |
| 3,757,355 | 9/1973 | Allen et al. | 5/604 |
| 3,922,735 | 12/1975 | Kato | 5/605 |
| 4,677,700 | 7/1987 | Su | 5/695 X |
| 5,077,845 | 1/1992 | Tokunaga et al. | 5/605 |
| 5,342,583 | 8/1994 | Son | 422/107 |
| 5,351,349 | 10/1994 | Tsai et al. | 5/604 |
| 5,461,738 | 10/1995 | Kimura et al. | 5/604 |
| 5,604,943 | 2/1997 | Kimura et al. | 5/604 |
| 5,842,237 | 12/1998 | Hargest et al. | 5/605 X |
| 5,926,875 | 7/1999 | Okamoto et al. | 5/605 |

*Primary Examiner*—Terry Lee Melius
*Assistant Examiner*—Robert G. Santos
*Attorney, Agent, or Firm*—Fleshner & Kim, LLP

[57] ABSTRACT

This invention relates in general to a dual-function bed used as a chair equipped with a patient toilet. The bed is designed to be selectively used as a chair by controlling the folding angle of it with the operation of a reduction motor. Moreover, as attached equipment, the toilet having the capabilities of cleaning itself and discharging excrement, gives great convenience to a patient. Subsequently, this invention allows a disabled and non-ambulatory patient to relieve oneself and rest by simply operating a control unit without nurse.

4 Claims, 7 Drawing Sheets

DUAL-FUNCTION FOLDING BED USED AS CHAIR EQUIPPED WITH PATIENT TOILET

BACKGROUND OF THE INVENTION

1. Field of the Invention

The present invention relates to the medical field, and provides a dual-function bed selectively used as a chair equipped with a patient toilet, the bed being particularly designed to allow a patient to operate the bed easily while changing the structural form of the bed between a chair and a bed as desired, with the toilet being attached to the bed and providing the patient with a convenience.

2. Description of the Prior Art

A disabled and non-ambulatory patient needs a nurse required to help him or her, especially when relieving oneself. In using a conventional portable patient toilet, at least one nurse's assistance is needed by a patient while relieving oneself since the toilet is not designed to allow the patient to use it without such assistance.

In addition, it is necessary for those around the patient to help the patient while washing after relieving oneself using such a conventional portable patient toilet.

SUMMARY OF THE INVENTION

Accordingly, the present invention is the solution of the above problems occurring in the prior art, and an object of the present invention is to provide a dual-function folding bed, which is designed to be selectively used as a chair or a bed and is equipped with a patient toilet, and which is easily controlled by a simple control unit.

In accordance with the preferred embodiment of this invention, the upper part of a bed consists of a plurality of parts: a backrest, a footrest and an intermediate board. The backrest and footrest, coupled to each other using two or more hinges, are commonly connected to a fixed intermediate board, wherein the backrest is pivoted by a reduction motor. The footrest is coupled to the backrest using a connection link in a way such that the footrest is moved downwardly when the backrest is raised up. Consequently, it is possible for a patient to selectively convert the bed into a chair with a simple operation when necessary.

Furthermore, the lower part of the bed is provided with a toilet, which consists of several parts; water intake port and outlet port, bubble outlet port, warm air inlet, excrement crusher, etc. An electronic circuit is provided in the bed so as to control all the devices, thus allowing a patient to relieve oneself with convenience without others' assistance.

BRIEF DESCRIPTION OF THE DRAWINGS

The above and other objects, features and other advantages of the present invention will be clearly understood from the following detailed description taken in conjunction with the accompanying drawings, wherein.

DESCRIPTION OF THE PREFERRED EMBODIMENTS

Figure 1:
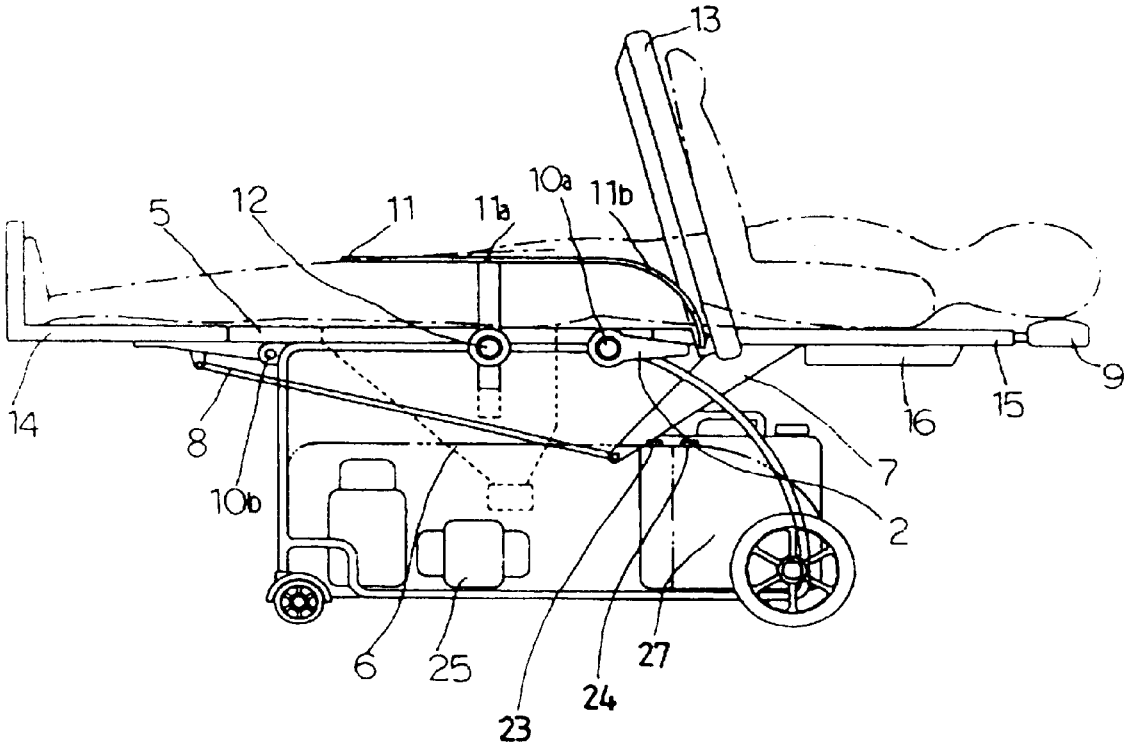
FIG. 1 is a side view of a dual-function folding bed made according to the preferred embodiment of the present invention.

FIG. 1 is a side view of a dual-function folding bed made according to the preferred embodiment of the present invention, showing the apparatus used as a bed with a patient being laid on.

In the bed of this invention, an operation switch (not shown) is installed on either of left and right armrests 13 of the bed, thus allowing a patient, laid on the bed, to control the bed with ease and convenience. A plurality of trolleys (not shown) are attached to the lower surface of each armrest 13 so that each armrest is slidable on a rail 11, consisting of a rectilinear section 11*a* and a curvilinear section 11*b*.

A height adjusting screw 12 is installed on a proper site of the rail 11, and so a patient is allowed to control the vertical position and angle of the rail 11. In providing the function as a bed, the lower surface of the armrest 13 is positioned adjacent to the rectilinear section 11*a* of the rail 11. In being used as a chair, the lower surface of the armrest 13 is positioned adjacent to the curvilinear section 11*b* of the rail 11. It is thus possible for the patient to freely adjust the position and angle of the armrest 13 as desired.

The bed of this invention is generally composed of three segments: a backrest 15, an intermediate board 5 and a footrest 14, wherein a headrest 9 is mounted to the upper end of the backrest 15. A control unit 16 is also attached to the backrest 15. A triangular link 7, linked to the footrest 14, is mounted to a lower part of the backrest 15. When the bed is changed from a chair structure to a bed structure, the backrest 15 pivots on a first hinge 10*a*, while the triangular link 7 pushes a connection link 8. This consequently makes the footrest 14 pivot on a second hinge 10*b* at the same displacement of the backrest 15. Unlike both the movable backrest 15 and the footrest 14, the intermediate board 5 is stationary with the toilet 6 being attached to the lower portion of said board 5.

The above toilet 6 is composed of a plurality of parts: an excrement tank 27, a compressor 25, a detergent tank 24, and two water tanks 23, which are connected to each other through connection pipes.

Figure 2:
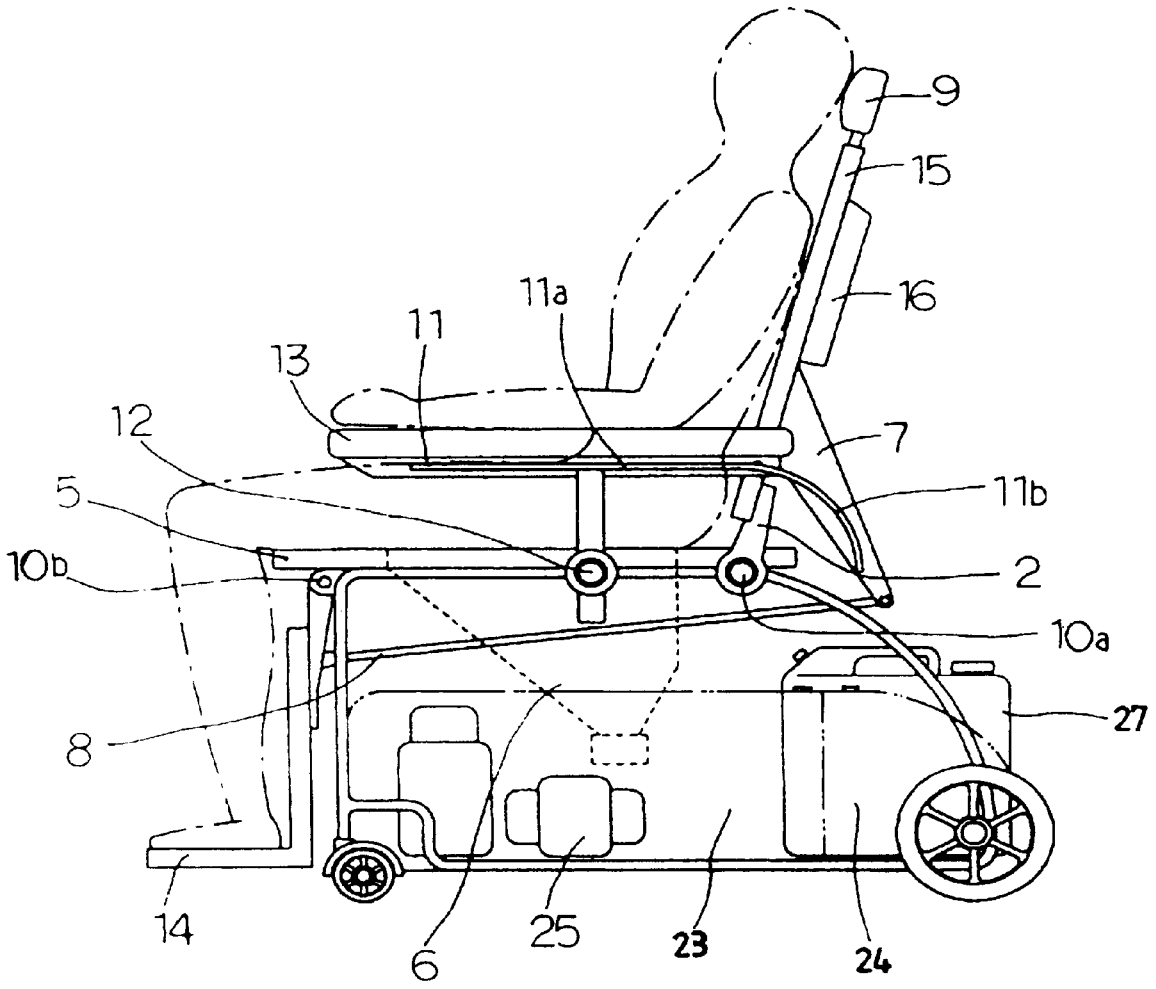
FIG. 2 is a side view of the above folding bed, showing the bed used as a chair.

FIG. 2 is a side view of the above folding bed, showing the bed used as a chair. When a patient wants to rest or relieve oneself, he operates a chair angle adjusting motor 2 by controlling a switch provided on the armrest 13.

The above motor 2 is a small capacity motor with internal gears, and generates sufficient torque enough to support a patient's weight while the backrest 15 is rotated upwardly on the first hinge 10*a*. When converting the shape of the bed into a chair, the trolleys, attached under each armrest 13, combine the armrest 13 with the rectilinear section 11*a* of the rail 11. The position and angle of the armrest 13 is thus controllable with ease. The triangular link or the first link 7, mounted to the lower portion of the backrest 15, is coupled to the footrest 14 and along with the second link 8, both extend across under the intermediate board 5 of the main body 1.

The process of converting the bed into the shape of a chair is performed as follows. The chair angle adjusting motor 2 primarily activates the backrest 15 so as to rotate the backrest 15 on the hinge 10*a* to the left in the drawings. This consequently pulls the first and second links 7 and 8, and moves the footrest 14 to the right in the drawings.

Figure 3:
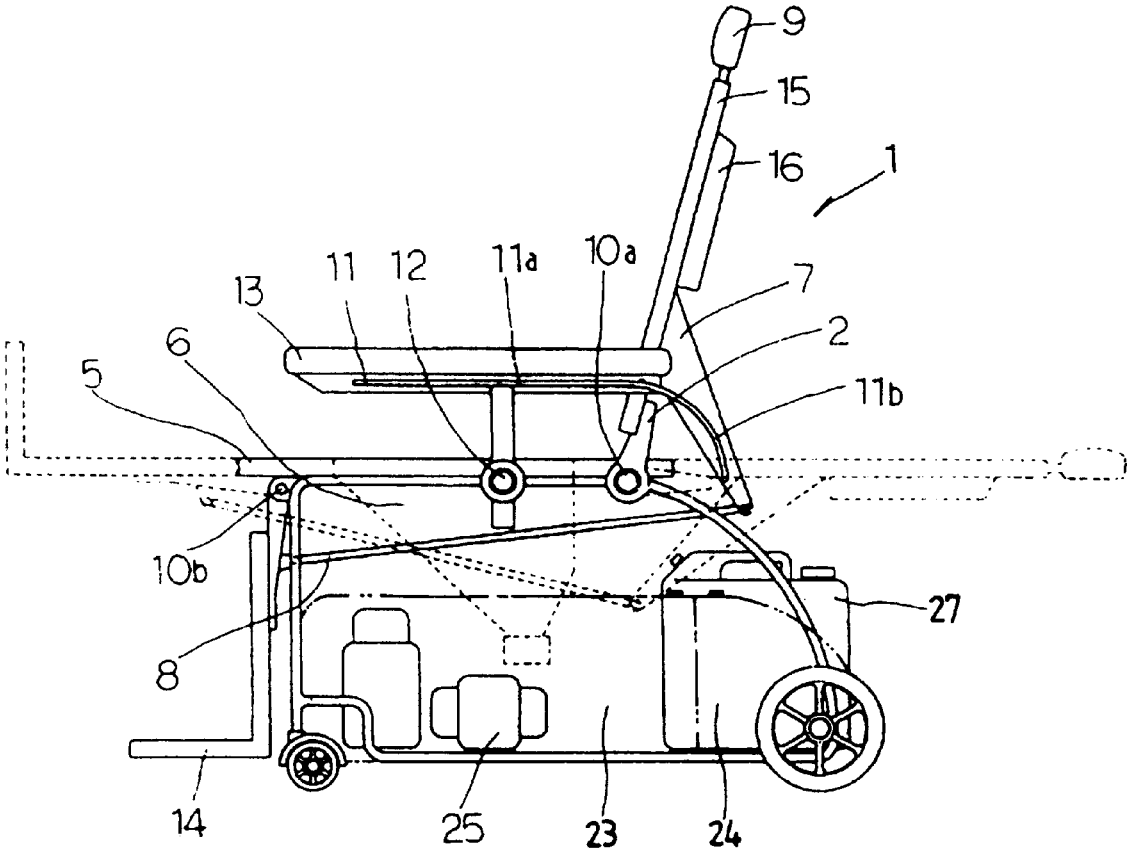
FIG. 3 is a schematic view showing the operation of the folding bed of the present invention.

FIG. 3 is a schematic view showing the operation of the folding bed of the present invention, wherein the dotted line indicates the shape of the bed.

Figure 4:
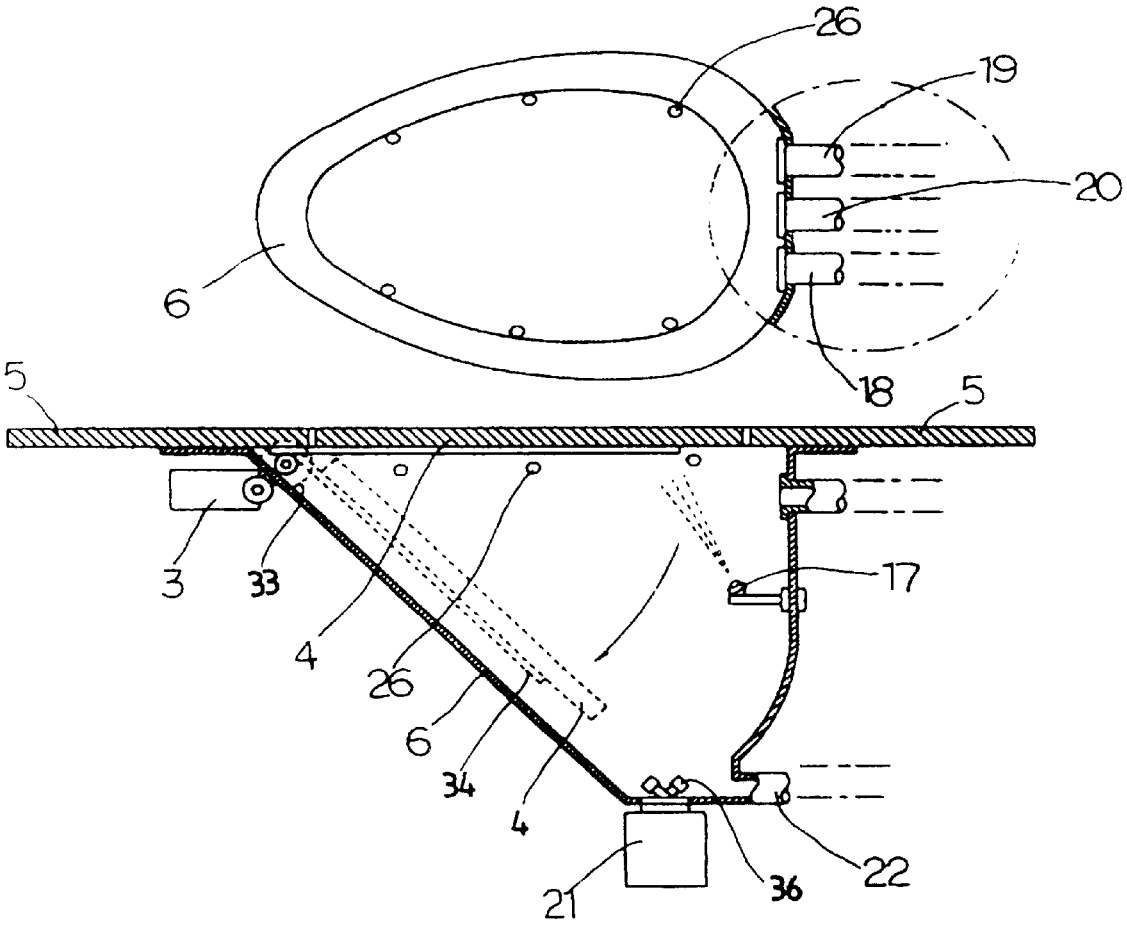
FIG. 4 is a view, showing a toilet, equipped in the folding bed of the invention, with a toilet lid closed.

FIG. 4 is a view showing the toilet equipped in the folding bed in detail. The toilet 6 includes a plurality of water outlet ports 26 along its inner-upper part. On the back of the toilet 6, a bubble intake port 18 is connected to a bubble generating system, which consists of a bubble generator 30 and a bubble solution dilutor 31. Next to the bubble intake port 18 are a warm air intake port 20 and an odor outlet port 19. The warm air intake port 20 is connected to a warm air fan having a dryer 32, while the odor outlet port 19 is connected to a deodorizer 35 having a deodorizing fan.

The intermediate board 5 includes a toilet lid 4. In the lid 4, a pinion 33 is attached to the end of a bracket 34, which is attached to the back of the lid 4. When a patient operates a switch for the toilet 6, the toilet lid 4 is rotated clockwise on the pinion 33 in the drawing since the lid 4 is rotated by a reduction motor 3 and the pinion 33 in accordance with a switching operation.

When the toilet lid 4 is rotated downwardly, the odor outlet port 19 begins to operate. Since this operation continues until a patient is finished relieving oneself, odor is effectively prevented from escaping. On the other hand, detergent bubbles, exhausted from the bubble intake port 18, preserve a patient's excrement from being adhered to the inside of the toilet 6 and makes the toilet 6 easy to clean.

When the patient's excrement is undesirably accumulated in the toilet 6, the crushing blade 36 of a crushing motor 21 breaks the excrement into fragments. Water from the water outlet ports 26 drives the excrement into the excrement tank 27 through an excrement suction port 22. This process is effectively performed by a sequential procedure of the water tanks 23, the detergent tank 24, and the compressor 25 provided in the main body 1.

Figure 5:
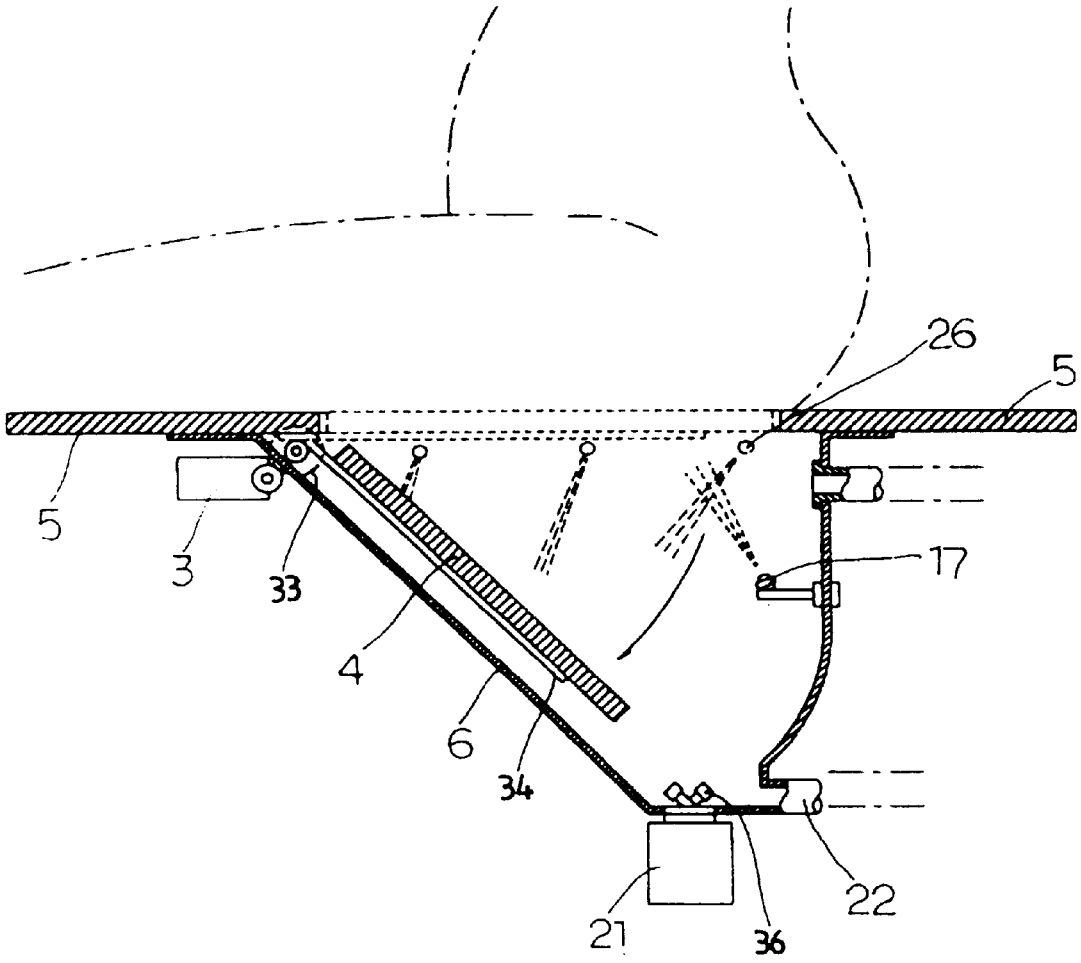
FIG. 5 is a sectional view showing the operation of the above toilet with the toilet lid open.

FIG. 5 is a sectional view, showing the operation of the above toilet 6 with the lid 4 open. After a patient finishes relieving oneself, a water injection nozzle 17, installed inside the toilet 6, emits pressurized water and washes a patient's anal region. The function of this system remains the same as that of a conventional bidet.

After the washing of the patient's anal region is accomplished, water from the water outlet ports 26 cleans the interior of the toilet 6 and the lid 4, with the lid 4 being positioned inside the toilet 6.

Thereafter, warmed air current from a warm air intake port 20 dries both a patient's anal region and the interior of the toilet 6. After the drying procedure, the reduction motor 3 moves the toilet lid 4 upwardly and closes the toilet 6. The bed thus becomes a chair.

Figure 6:
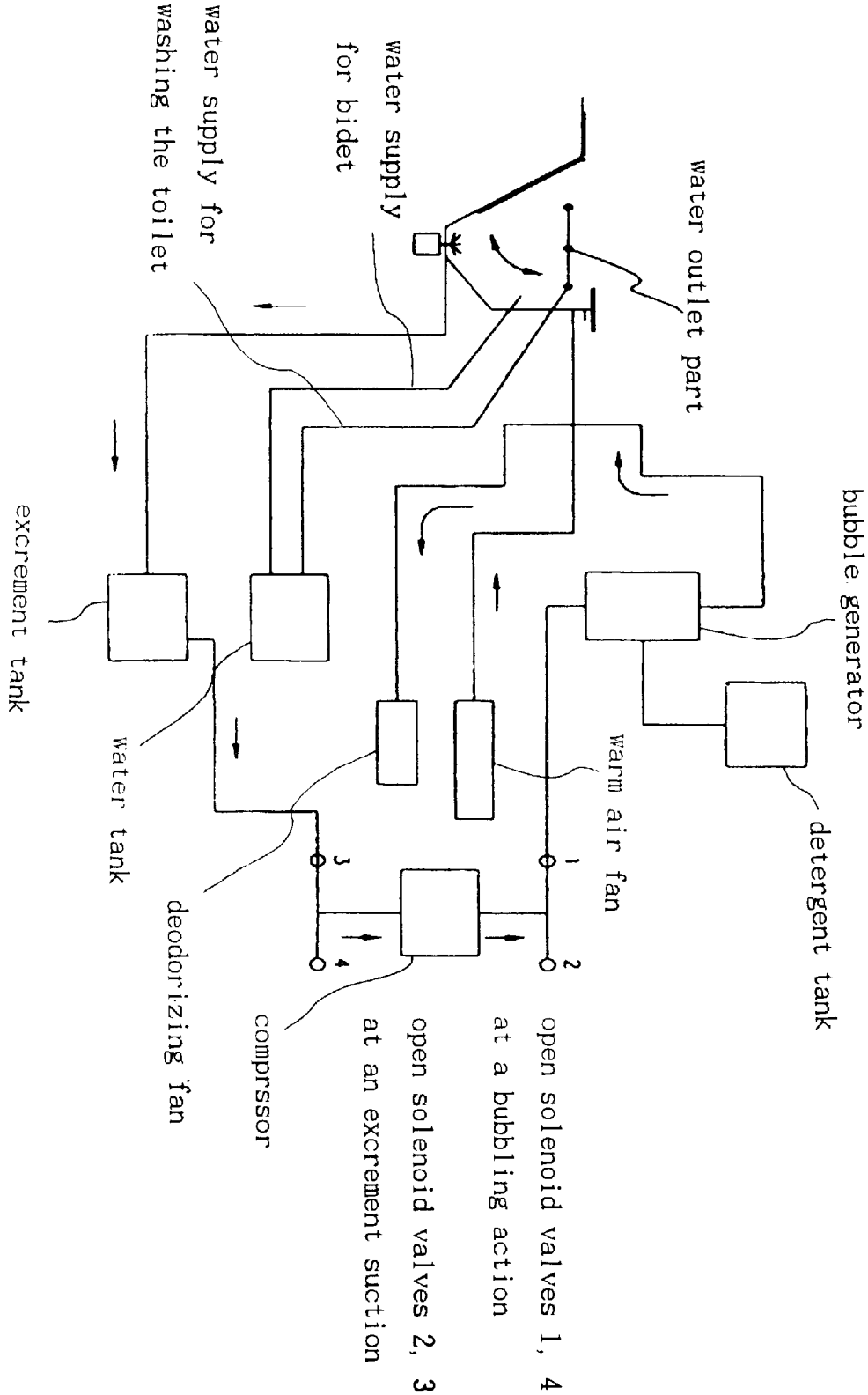
FIG. 6 is a block diagram showing the operation of the toilet of this invention.
Figure 7:
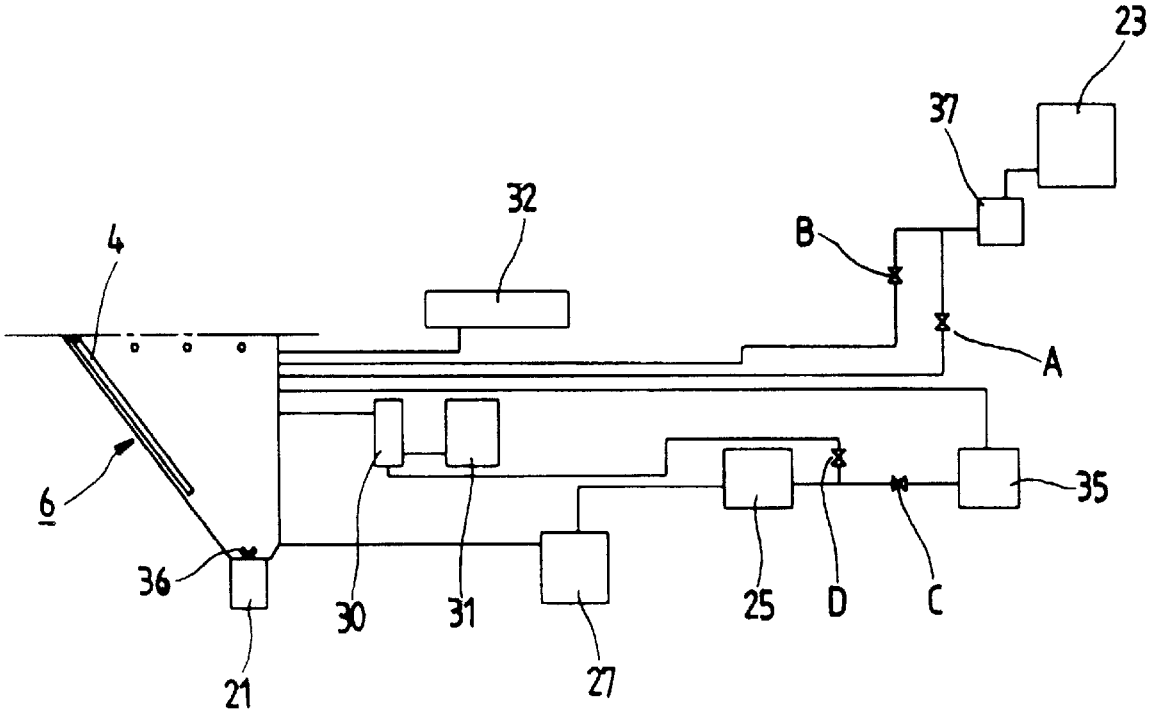
FIG. 7 is a block diagram showing the operation of the above toilet in further detail.

Referring now to the block diagrams of FIGS. 6 and 7, the detailed process of each procedure is described as follows.

As a patient controls the switch on the armrest 13, the reduction motor 3 rotates the pinion 33 and pivots the toilet lid 4 clockwise in the drawings, while the compressor 25 starts to run. The bubble generator 30 thus spouts bubbles from the bubble solution dilutor 31 into the interior of the toilet 6 through the bubble intake port 18.

Next, when a patient switches on the excrement discharging system after relieving oneself, the crushing motor 21 rotates the crushing blade 36, thus breaking the accumulated excrement into fragments. The crushed excrement flows into the excrement tank 27 through the excrement suction port 22 by the indraft operation of the compressor 25. Concurrently with the above procedure, the water injection nozzle 17 emits pressurized water and washes the patient's anal region. In such a case, the water flows from the water tank 23 through the valve A and pipes (not shown) by a pumping force of a pump 37.

After the excrement collecting and cleaning procedure, the dryer 32 dries both the patient's anal region and the toilet lid 4. After the drying procedure, the reduction motor 3 moves the toilet lid 4 back to its original position in the intermediate board 5.

When the patient switches the toilet lid 4 open, the deodorizer 35 removes the excrement odor from the toilet 6 by the indraft operation of the compressor 25. In a detailed description, as the compressor 25 is operated, a valve C allows the odor intake port 19 to breathe the odor from the toilet 6 through the odor outlet port 19 connected to the deodorizer 35. At the same time, another valve D sucks the odor from the excrement tank 27. Therefore, during the operation of this apparatus, such a continuous indraft of odor from the tank 27 allows a patient to have a greater degree of comfort while relieving oneself. As the excrement tank 27 is designed to be easily detached from the main body 1, a nurse can handle and remove the excrement of the tank 27 easily and conveniently.

As described above, the present invention provides a dual-function bed selectively used as a chair equipped with a patient toilet. It is thus possible for an unassisted patient to rest selectively on a bed or a chair, and to relieve oneself without others' help with a simple operation of a control unit. Therefore, the invention solves the prior art's problem in that a nurse's assistance is needed by a patient while relieving oneself.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dual-function folding bed selectively used as a chair or a bed, comprising:

a main body designed to be selectively used as a chair or a bed, said main body consisting of:

a backrest having a headrest and a control unit;

an intermediate board hinged to said backrest, with both a chair angle adjusting motor provided at a junction between the backrest and the intermediate board and an armrest provided at each side of said backrest, said intermediate board also having a rail with a height adjusting screw, said rail having a rectilinear section and curvilinear section, with the armrest lying on said rail a toilet lid having a reduction motor and provided at a middle portion of the intermediate board;

a toilet provided under the toilet lid, said toilet having a water outlet port, a bubble intake port, an odor outlet port, a warm air intake port, a water injection nozzle, a crushing motor, and an excrement suction port therein;

a water tank, a detergent tank, a compressor, and an excrement tank provided in the main body at a position under the toilet; and a footrest hinged to one end of said intermediate board.

2. The folding bed according to claim 1, wherein said intermediate board is a fixed member with both said backrest and said footrest being commonly connected to the intermediate board using a plurality of hinges, and a triangular connection link is provided at a lower portion of said backrest and is coupled to the footrest through a second connection link, thus allowing said backrest to be operated in conjunction with said footrest.

3. The folding bed according to claim 1, wherein said chair angle adjusting motor is provided at a hinged portion of the backrest for operating the backrest, and a reduction motor is provided at a side of the toilet lid for operating the toilet lid.

4. The folding bed according to claim 1, wherein the bubble intake port, the odor outlet port, the warm air intake port, and the water outlet port are interiorly provided at an upper part of said toilet, said water injection nozzle is interiorly provided at a middle part of the toilet, and said crushing motor and an excrement intake port are provided at a lower part of said toilet.

* * * * *